US010699659B2

(12) United States Patent
Xu

(10) Patent No.: US 10,699,659 B2
(45) Date of Patent: Jun. 30, 2020

(54) GATE DRIVER ON ARRAY CIRCUIT AND LIQUID CRYSTAL DISPLAY WITH THE SAME

(71) Applicant: Shenzhen China Star Optoelectronics Technology Co., Ltd., Shenzhen, Guangdong (CN)

(72) Inventor: Xiangyang Xu, Shenzhen (CN)

(73) Assignee: Shenzhen China Star Optoelectronics Technology Co. Ltd., Shenzhen, Guangdong (CN)

( * ) Notice: Subject to any disclaimer, the term of this patent is extended or adjusted under 35 U.S.C. 154(b) by 76 days.

(21) Appl. No.: 15/575,157

(22) PCT Filed: Nov. 6, 2017

(86) PCT No.: PCT/CN2017/109519
§ 371 (c)(1),
(2) Date: Nov. 17, 2017

(87) PCT Pub. No.: WO2019/061681
PCT Pub. Date: Apr. 4, 2019

(65) Prior Publication Data

US 2019/0096348 A1 Mar. 28, 2019

(51) Int. Cl.
*G09G 3/36* (2006.01)

(52) U.S. Cl.
CPC ... *G09G 3/3677* (2013.01); *G09G 2300/0408* (2013.01); *G09G 2310/06* (2013.01);
(Continued)

(58) Field of Classification Search
CPC ..... G09G 3/36; G09G 3/3622; G09G 3/3625; G09G 3/3677; G09G 2310/06;
(Continued)

(56) References Cited

U.S. PATENT DOCUMENTS 10,049,636 B2 * 8/2018 Xu ..... G09G 3/3677
10,332,468 B2 * 6/2019 Xu ..... G09G 3/3677
(Continued)

FOREIGN PATENT DOCUMENTS

CN 106057157 A 10/2016
CN 106098101 A 11/2016
(Continued)

*Primary Examiner* — Alexander Eisen
*Assistant Examiner* — Nelson Lam
(74) *Attorney, Agent, or Firm* — Mark M. Friedman

(57) ABSTRACT

A gate driver on array (GOA) circuit includes cascaded GOA unit circuits. An nth stage GOA unit circuit includes a clock signal source, a constant voltage supply, a pull-up control circuit, a pull-up circuit, a downlink circuit, a pull-down circuit, a pull-down maintaining circuit, a bootstrap capacitor and a conducting control circuit. An output terminal of the pull-up control circuit is electrically connected to the pull-up circuit, the downlink circuit, the pull-down circuit, the pull-down maintaining circuit, and the bootstrap capacitor. The constant voltage supply is electrically connected to the pull-down maintaining circuit and the pull-down circuit. The clock signal source is electrically connected to the pull-up circuit, the downlink circuit, and the conducting control circuit. The conducting control circuit is electrically connected to the pull-down maintaining circuit.

15 Claims, 4 Drawing Sheets

(52) U.S. Cl.
CPC ... *G09G 2310/08* (2013.01); *G09G 2320/043* (2013.01); *G09G 2330/021* (2013.01)

(58) Field of Classification Search
CPC ..... G09G 2310/08; G09G 2320/043; G09G 2320/045; G09G 2330/021
USPC ..... 345/87–104
See application file for complete search history.

(56) References Cited

U.S. PATENT DOCUMENTS 10,388,202 B2 * 8/2019 Xu ..... G02F 1/13454
2014/0159997 A1 6/2014 Chen et al.
2015/0187312 A1 * 7/2015 Dai ..... G09G 3/3648 345/213
2016/0140926 A1 * 5/2016 Xiao ..... G09G 3/3677 345/215
2016/0140928 A1 * 5/2016 Xiao ..... G09G 3/3648 345/212
2016/0148589 A1 * 5/2016 Cao ..... G09G 3/3677 345/208
2016/0171949 A1 * 6/2016 Dai ..... G09G 3/3677
2016/0180788 A1 * 6/2016 Xiao ..... G09G 3/3677 345/204
2016/0189647 A1 * 6/2016 Xiao ..... G09G 3/3677 345/92
2016/0189648 A1 * 6/2016 Xiao ..... G09G 3/3677 345/212
2016/0189649 A1 * 6/2016 Xiao ..... G11C 19/28 345/214
2016/0284303 A1 * 9/2016 Dai ..... G09G 3/36
2017/0047031 A1 * 2/2017 Cao ..... G02F 1/136286
2018/0211629 A1 7/2018 Zeng
2018/0268914 A1 9/2018 Zhao et al.
2019/0096348 A1 * 3/2019 Xu ..... G09G 3/3677

FOREIGN PATENT DOCUMENTS

CN 106128401 A 11/2016
CN 106205528 A 12/2016
CN 106297715 A 1/2017

* cited by examiner

GATE DRIVER ON ARRAY CIRCUIT AND LIQUID CRYSTAL DISPLAY WITH THE SAME

BACKGROUND

1. Field of the Disclosure

The present disclosure relates to the field of a liquid crystal panel technique, and more particularly, to a gate driver on array (GOA) circuit and a liquid crystal display (LCD) with the GOA circuit.

2. Description of the Related Art

A trend of a liquid crystal display (LCD) is to utilize a narrow bezel, to be thin, and low cost. A gate driver on array (GOA) technique is important for such a development tendency. A scanning line driving circuit is integrated on an array substrate of a liquid crystal panel with the GOA technique, thereby reducing the production cost from the materials and manufacturing processes.

FIG. 1 is a circuit diagram of a GOA circuit of the related art. The GOA circuit of the related art includes a control circuit 101, a pull-up circuit 102, a pull-down circuit 103, and a pull-down maintaining circuit 104. Further, the pull-down maintaining circuit 104 includes a first pull-down maintaining circuit 1041 and a second pull-down maintaining circuit 1042. When a scanning signal G(n−5) electrically connected to a twentieth thin-film transistor (TFT) T11 is at a high voltage level, a bootstrap capacitor is charged to raise the voltage level of a reference node Q(n). Meanwhile, a fourth TFT T21 is turned on, thereby raising the voltage level of a scanning signal G(n) through the first clock signal CLK1 at the high voltage level and outputting a scanning signal G(n) at the high voltage level. When a scanning signal G(n+5) electrically connected to a sixth TFT T31 and a ninth TFT T41 are at the high voltage level, the voltage level of a reference node G(n) and the voltage level of a reference node Q(n) are lowered by the pull-down circuit at the same time. At this time, the voltage level of the reference node Q(n) is at a low voltage level. When a first square-wave signal LC1 (or a second square-wave signal LC2) is at a high voltage level, the first pull-down maintaining circuit and the second pull-down maintaining circuit continue being turned on. The control timing of the GOA circuit is illustrated in FIG. 2, which can be referred if needed. The first square-wave signal LC1 and the second square-wave signal LC2 are low-frequency signals (the first square-wave signal LC1 and the second square-wave signal LC2 are signals with a cycle of 200 frames, and the first square-wave signal LC1 and the second square-wave signal LC2 are signals which rotate once per 100 frames compared with a clock signal CLK with a cycle of every eight rows, which fails to be illustrated in FIG. 2). The phase difference between the first square-wave signal LC1 and the second square-wave signal LC2 is half the cycle. The change of the voltage level of the reference node Q(n) is illustrated in FIG. 3. When the reference node Q(n) is at a high level, the first square-wave signal LC1 (or the second square-wave signal LC2) is at a high level. Meanwhile, a twelfth TFT T51 and a thirteenth TFT T52 (or a sixteenth TFT T61 and a seventeenth TFT T62) are turned on. In other words, the first square-wave signal LC1 and the second square-wave signal LC2 are conducted to a constant voltage supply VSS through the twelfth TFT T51 and the thirteenth TFT T52 (or the sixteenth TFT T61 and the seventeenth TFT T62). The conducted time is t1+t2. In this case, the greatest amount of current flows through the twelfth TFT T51 and the thirteenth TFT T52 (or the sixteenth TFT T61 and the seventeenth TFT T62). As a result, the twelfth TFT T51 and the thirteenth TFT T52 (or a sixteenth TFT T61 and a seventeenth TFT T62) are inclined to be aged rapidly when the GOA circuit operates long time. More power consumes as well. Therefore, it is very important to solve the problem of aging of the TFTs to design a high-quality LCD.

SUMMARY

An object of the present disclosure is to propose a gate driver on array (GOA) circuit and a liquid crystal display (LCD) with the GOA circuit. In the present disclosure, the conducted time when a square-wave signal is fed to a thin-film transistor (TFT) of a pull-down maintaining circuit in the GOA circuit is shortened to inhibit the aging speed of the TFTs and reduce power consumption, thereby enhancing reliability of the GOA circuit and lowering the power consumption of the liquid crystal panel.

According to a first aspect of the present disclosure, a gate driver on array (GOA) circuit applying to a liquid crystal panel is provided. The GOA circuit includes a plurality of cascaded GOA unit circuits. An nth stage GOA unit circuit includes a clock signal source, a constant voltage supply, a pull-up control circuit, a pull-up circuit, a downlink circuit, a pull-down circuit, a pull-down maintaining circuit, a bootstrap capacitor, a conducting control circuit and a beveled control signal circuit. A clock signal source is configured to supply a current-stage clock signal. The clock signal includes a first high voltage level and a first low voltage level. The constant voltage supply is configured to supply a second low voltage level. The pull-up control circuit is configured to receive an (n−1)th stage scanning signal and generate a current-stage scanning voltage level signal under a control of an (n−1)th stage cascade signal. The pull-up circuit is configured to output the current-stage clock signal to an output terminal of a current-stage scanning signal under a control of the current-stage scanning voltage level signal. The downlink circuit is configured to receive the current-stage clock signal and generate an nth stage cascade signal under a control of the current-stage scanning voltage level signal. The pull-down circuit is configured to output the second low voltage level supplied by the constant voltage supply to the output terminal of the current-stage scanning signal according to an (n+1)th stage scanning signal. The pull-down maintaining circuit is configured to maintain the current-stage scanning voltage level signal at a low voltage level. The bootstrap capacitor is configured to generate the current-stage scanning voltage level signal at a high voltage level. The conducting control circuit is configured to control conducted time when the pull-down maintaining circuit receives a square-wave signal of the TFT. The conducting control circuit includes a first thin film transistor (TFT) and a second TFT. A gate of the first TFT receives the current-stage clock signal. A source of the first TFT receives a first square-wave signal. A drain of the first TFT is electrically connected to the pull-down maintaining circuit. A gate of the second receives the current-stage clock signal. A source of the second TFT receives a second square-wave signal. A drain of the second TFT is electrically connected to the pull-down maintaining circuit. The beveled control signal circuit is configured to output a beveled control signal under the control of the current-stage clock signal. The pull-up circuit is configured to output the beveled control signal to the output terminal of the current-stage scanning signal under the control of the current-stage scanning voltage level signal. The downlink circuit is configured to receive the beveled control signal and generate a second stage cascade signal under the control of the current-stage scanning voltage level signal. The clock signal source is electrically connected to the beveled control signal circuit. The beveled control signal circuit is electrically connected to the pull-up circuit and the downlink circuit. An output terminal of the pull-up control circuit is electrically connected to the pull-up circuit, the downlink circuit, the pull-down circuit, the pull-down maintaining circuit, and the bootstrap capacitor. The constant voltage supply is electrically connected to the pull-down maintaining circuit and the pull-down circuit. The clock signal source is electrically connected to the pull-up circuit, the downlink circuit, and the conducting control circuit. The conducting control circuit is electrically connected to the pull-down maintaining circuit.

According to a second aspect of the present disclosure, a gate driver on array (GOA) circuit applying to a liquid crystal panel is provided. The GOA circuit includes a plurality of cascaded GOA unit circuits. An nth stage GOA unit circuit includes a clock signal source, a constant voltage supply, a pull-up control circuit, a pull-up circuit, a downlink circuit, a pull-down circuit, a pull-down maintaining circuit, a bootstrap capacitor, a conducting control circuit and a beveled control signal circuit. A clock signal source is configured to supply a current-stage clock signal. The clock signal includes a first high voltage level and a first low voltage level. The constant voltage supply is configured to supply a second low voltage level. The pull-up control circuit is configured to receive an (n−1)th stage scanning signal and generate a current-stage scanning voltage level signal under a control of an (n−1)th stage cascade signal. The pull-up circuit is configured to output the current-stage clock signal to an output terminal of a current-stage scanning signal under a control of the current-stage scanning voltage level signal. The downlink circuit is configured to receive the current-stage clock signal and generate an nth stage cascade signal under a control of the current-stage scanning voltage level signal. The pull-down circuit is configured to output the second low voltage level supplied by the constant voltage supply to the output terminal of the current-stage scanning signal according to an (n+1)th stage scanning signal. The pull-down maintaining circuit is configured to maintain the current-stage scanning voltage level signal at a low voltage level. The bootstrap capacitor is configured to generate the current-stage scanning voltage level signal at a high voltage level. The conducting control circuit is configured to control conducted time when the pull-down maintaining circuit receives a square-wave signal of the TFT. An output terminal of the pull-up control circuit is electrically connected to the pull-up circuit, the downlink circuit, the pull-down circuit, the pull-down maintaining circuit, and the bootstrap capacitor. The constant voltage supply is electrically connected to the pull-down maintaining circuit and the pull-down circuit. The clock signal source is electrically connected to the pull-up circuit, the downlink circuit, and the conducting control circuit. The conducting control circuit is electrically connected to the pull-down maintaining circuit.

According to an embodiment of the second aspect of the present disclosure, the conducting control circuit comprises a first thin film transistor (TFT) and a second TFT. A gate of the first TFT receives the current-stage clock signal. A source of the first TFT receives a first square-wave signal. A drain of the first TFT is electrically connected to the pull-down maintaining circuit. A gate of the second receives the current-stage clock signal. A source of the second TFT receives a second square-wave signal. A drain of the second TFT is electrically connected to the pull-down maintaining circuit.

According to an embodiment of the second aspect of the present disclosure, the GOA circuit further comprises a beveled control signal circuit configured to output a beveled control signal under the control of the current-stage clock signal. The pull-up circuit is configured to output the beveled control signal to the output terminal of the current-stage scanning signal under the control of the current-stage scanning voltage level signal. The downlink circuit is configured to receive the beveled control signal and generate a second stage cascade signal under the control of the current-stage scanning voltage level signal. The clock signal source is electrically connected to the beveled control signal circuit. The beveled control signal circuit is electrically connected to the pull-up circuit and the downlink circuit, According to an embodiment of the second aspect of the present disclosure, the beveled control signal circuit comprises a third TFT. The third TFT comprises a gate coupled to the current-stage clock signal, a drain coupled to the beveled control signal, and a source coupled the pull-up circuit and the downlink circuit.

According to an embodiment of the second aspect of the present disclosure, the pull-up circuit comprises a fourth TFT. A gate of the fourth TFT is electrically connected to the output terminal of the pull-up control circuit. A drain of the fourth TFT is electrically connected to the beveled control signal circuit. A source of the fourth TFT is electrically connected to the output terminal of the current-stage scanning signal.

According to an embodiment of the second aspect of the present disclosure, the pull-down circuit comprises a sixth TFT and a ninth TFT. A gate of the sixth TFT is electrically connected to an output terminal of the (n+1)th stage scanning signal. A source of the sixth TFT is electrically connected to the constant voltage supply. A drain of the sixth TFT is electrically connected to the output terminal of the current-stage scanning signal. A gate of the ninth TFT is electrically connected to the output terminal of the (n+1)th stage scanning signal. A source of the ninth TFT is electrically connected to the constant voltage supply. A drain of the ninth TFT is electrically connected to the output terminal of the pull-up control circuit.

According to an embodiment of the second aspect of the present disclosure, the pull-up control circuit comprises an twentieth TFT. A gate of the twentieth TFT receives the (n−1)th stage cascade signal. A source of the twentieth TFT is electrically connected to the output terminal of the pull-up control circuit. A drain of the twentieth TFT receives the (n−1)th stage scanning signal.

According to an embodiment of the second aspect of the present disclosure, the downlink circuit comprises a fifth TFT. A gate of the TFT is electrically connected to the output terminal of the pull-up control circuit. A source of the fifth TFT receives the nth stage cascade signal.

According to an embodiment of the second aspect of the present disclosure, the pull-down maintaining circuit comprises a first pull-down maintaining circuit and a second pull-down maintaining circuit. The first pull-down maintaining circuit comprises a twelfth TFT, a thirteenth TFT, a fourteenth TFT, a fifteenth TFT, a tenth TFT, and a seventh TFT. A gate and a drain of the twelfth TFT are electrically connected to a first output terminal of the conducting control circuit. A source of the twelfth TFT is electrically connected to a drain of the thirteenth TFT and a gate of the fourteenth TFT. A gate of the thirteenth TFT receives the current-stage scanning voltage level signal. A source of the thirteenth TFT is electrically connected to the constant voltage supply. A drain of the fourteenth is electrically connected to the first output terminal of the conducting control circuit. A source of the fourteenth TFT is electrically connected to a drain of the fifteenth TFT, a gate of the tenth TFT, and a gate of the seventh TFT. A gate of the fifteenth TFT receives the current-stage scanning voltage level signal. A source of the fifteenth TFT is electrically connected to the constant voltage supply. A source of the tenth TFT is electrically connected to the constant voltage supply. A drain of the tenth TFT is electrically connected to the output terminal of the pull-up control circuit. A source of the seventh TFT is electrically connected to the constant voltage supply. A drain of the seventh TFT receives the current-stage scanning signal. The second pull-down maintaining circuit comprises a sixteenth TFT, a seventeenth TFT, an eighteenth TFT, a nineteenth TFT, a eleventh TFT, and an eighth TFT. A gate and a drain of the sixteenth TFT are electrically connected to a second output terminal of the conducting control circuit. A source of the sixteenth TFT is electrically connected to a drain of the seventeenth TFT and a gate of the eighteenth TFT. A gate of the seventeenth TFT receives the current-stage scanning voltage level signal. A source of the seventeenth TFT is electrically connected to the constant voltage supply. A drain of the eighteenth TFT is electrically connected to the second output terminal of the conducting control circuit. A source of the eighteenth TFT is electrically connected to a drain of the nineteenth TFT, a gate of the eleventh TFT, and a gate of the eighth TFT. A gate of the nineteenth TFT receives the current-stage scanning voltage level signal. A source of the nineteenth TFT is electrically connected to the constant voltage supply. A source of the eleventh TFT is electrically connected to the constant voltage supply. A drain of the eleventh TFT is electrically connected to the output terminal of the pull-up control circuit. A source of the eighth TFT is electrically connected to the constant voltage supply. A drain of the eighth TFT receives the current-stage scanning signal.

According to a third aspect of the present disclosure, a liquid crystal display comprising the GOA circuit as provided above.

Compared with the GOA circuit of the related art, new TFTs are respectively added to an input terminal of a twelfth TFT T51 and an input terminal of a thirteenth TFT T52 in the pull-down maintaining circuit in the GOA circuit proposed by the present disclosure. Gates of the new added TFTs both receive a clock signal. Drains of the new added TFTs receive a square-wave signal respectively. In this way, the conducted time when the pull-down maintaining circuit in the GOA circuit receives the square-wave signals of the TFTs is shortened to inhibit the aging speed of the TFTs, and the lifespan of the GOA circuit is prolonged, thereby enhancing reliability of the GOA circuit and lowering the power consumption of the liquid crystal panel.

DETAILED DESCRIPTION OF THE EMBODIMENTS

A gate driver on array (GOA) circuit and a liquid crystal display (LCD) with the GOA circuit proposed by the present disclosure are detailed with the attached figures.

Figure 1:
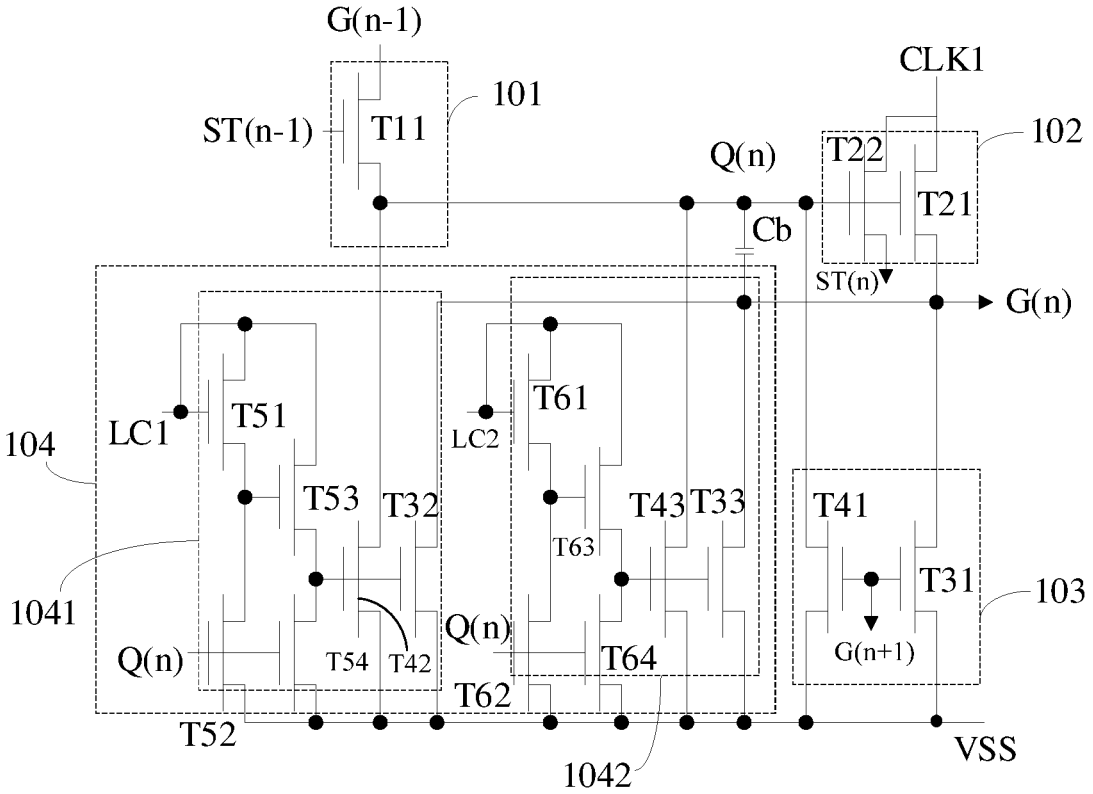
Fig. 1 (Prior Art)
FIG. 1 is a circuit diagram of a GOA circuit of the related art.
Figure 2:
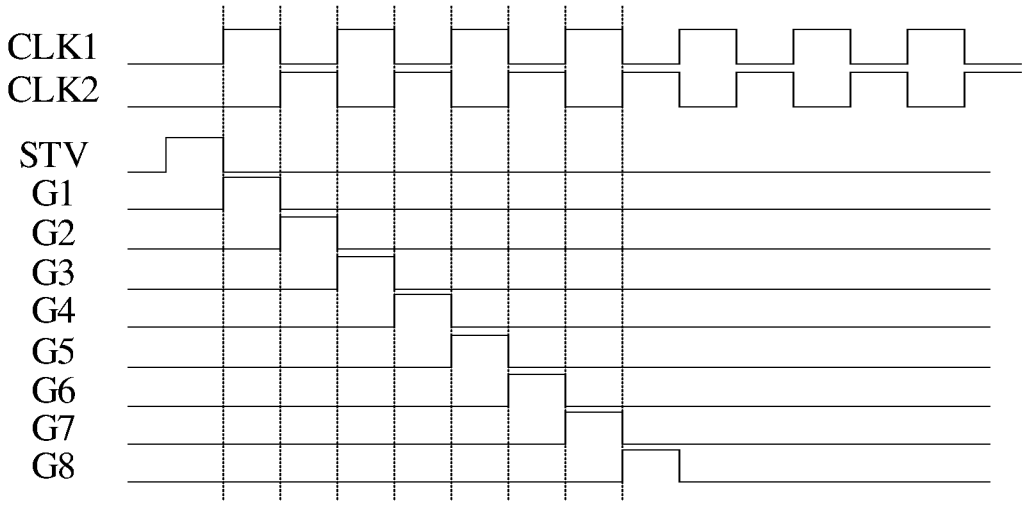
Fig. 2 (Prior Art)
FIG. 2 illustrates a timing diagram of relating signals applied on the GOA circuit of FIG. 1.
Figure 3:
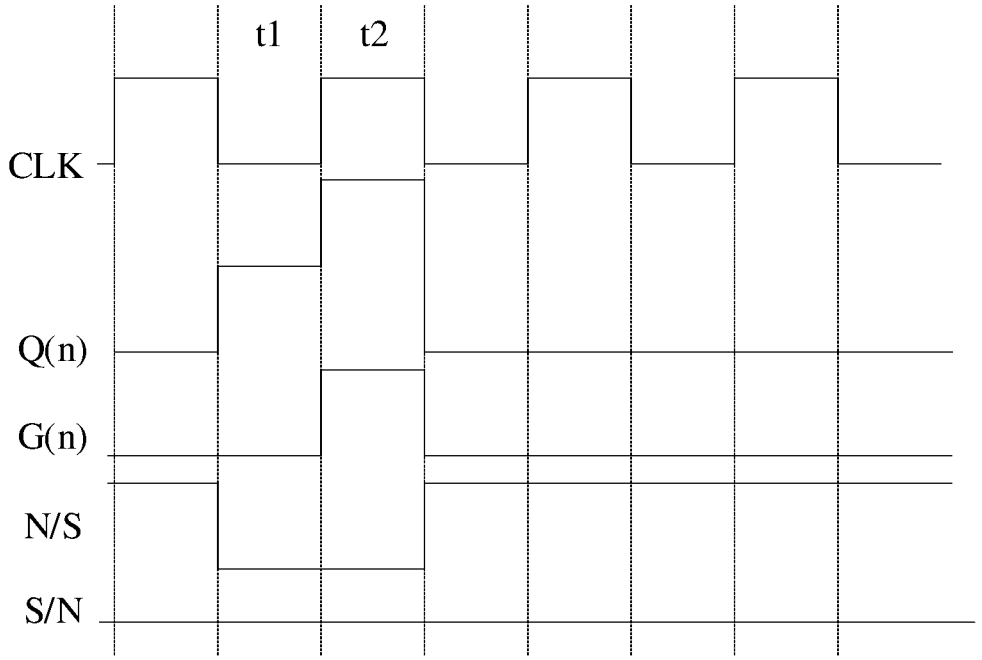
Fig. 3 (Prior Art)
FIG. 3 illustrates waveforms of clock signal and signals applied on nodes Q(n), G(n), N and S of the GOA circuit illustrated in FIG. 1.
Figure 4:
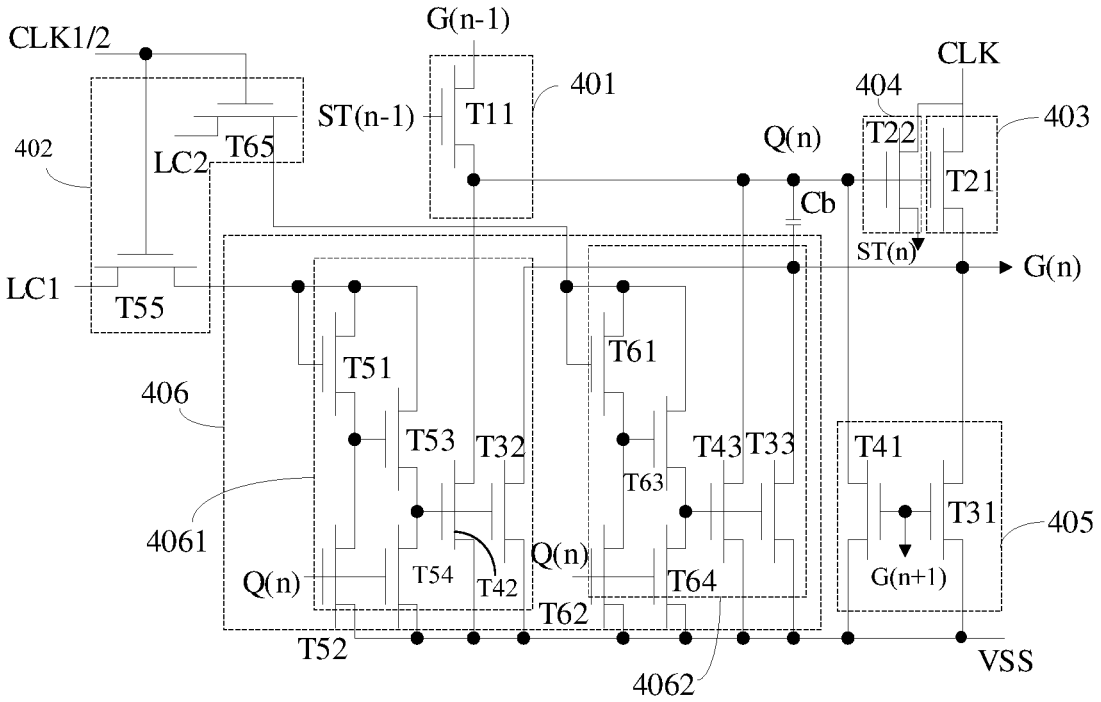
FIG. 4 is a circuit diagram of a GOA circuit according to an embodiment of the present disclosure.
Figure 6:
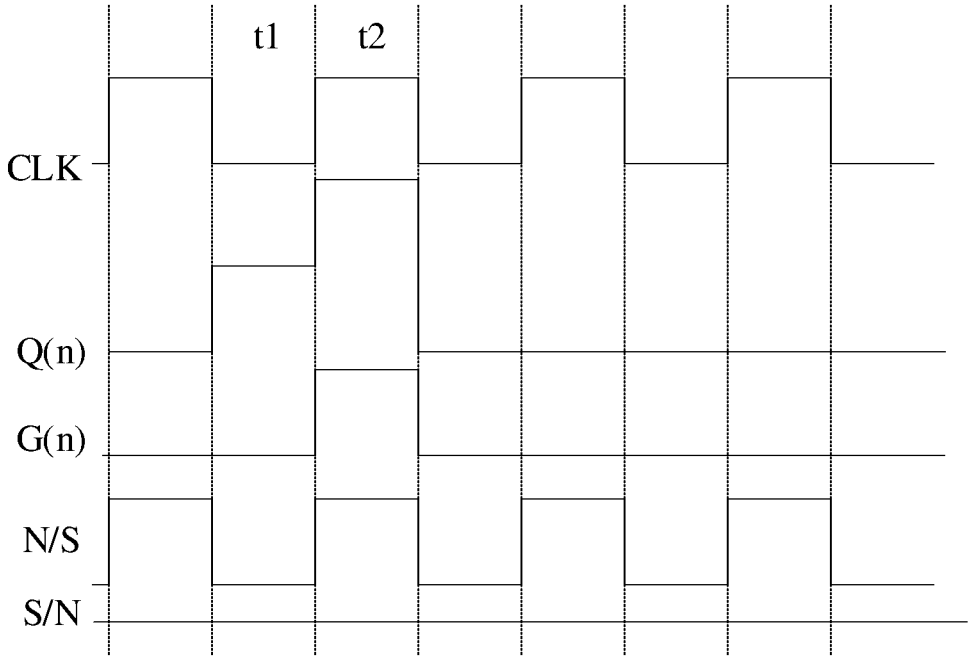
FIG. 6 illustrates waveforms of clock signal and signals applied on nodes Q(n), G(n), N and S of the GOA circuit illustrated in FIG. 5.

Please refer to FIG. 4 and FIG. 6. A GOA circuit is proposed by a first embodiment of the present disclosure. The GOA circuit may apply to a liquid crystal panel. The GOA circuit (i.e., a gate driving circuit) includes a plurality of cascaded GOA unit circuits. Each of the plurality of cascaded GOA unit circuits at each stage receives a corresponding clock signal. The GOA circuit includes two clock signals, a first clock signal CLK1 and a second clock signal CLK2, in the first embodiment. Each of the clock signals includes a first high voltage level VGH and a first low voltage level VGL. The first clock signal CLK1 receives a first, third, fifth, . . . , (2k+1)th stage GOA unit circuit, and the second clock signal CLK2 receives a second, fourth, sixth, . . . , (2k+2)th stage GOA unit circuit where k is an integer. The first clock signal CLK1 and the second clock signal CLK2 both are square waves of which a duty cycle is ½. The difference between the first clock signal CLK1 and the second clock signal CLK2 is half the cycle.

The nth stage GOA unit circuit includes a clock signal source CLK, a constant voltage supply VSS, a pull-up control circuit 401, a pull-up circuit 403, a downlink circuit 404, a pull-down circuit 405, a pull-down maintaining circuit 406, a bootstrap capacitor Cb, and a conducting control circuit 402. An output terminal of the pull-up control circuit 401 is electrically connected to the pull-up circuit 403, the downlink circuit 404, the pull-down circuit 405, the pull-down maintaining circuit 406, and the bootstrap capacitor Cb. The constant voltage supply VSS is electrically connected to the pull-down maintaining circuit 406 and the pull-down circuit 405. The clock signal source CLK is electrically connected to the pull-up circuit 403, the downlink circuit 404, and the conducting control circuit 402, respectively. The conducting control circuit 402 is electrically connected to the pull-down maintaining circuit 406.

Specifically, the clock signal source CLK is configured to supply a current-stage clock signal. The clock signal includes a first high voltage level and a first low voltage level. The constant voltage supply VSS is configured to supply a second low voltage level. The pull-up control circuit 401 is configured to receive an (n−1)th stage scanning signal and generate the current-stage scanning voltage level signal Q(n) under the control of an (n−1)th stage cascade signal. The pull-up circuit 403 is configured to output the current-stage clock signal to the current-stage scanning signal G(n) under the control of the current-stage scanning voltage level signal Q(n). The downlink circuit 404 is configured to receive the current-stage clock signal and generate an nth stage cascade signal under the control of the current-stage scanning voltage level signal Q(n). The pull-down circuit 405 is configured to output the second low voltage level supplied by the constant voltage supply VSS to the current-stage scanning signal G(n) according to the (n+1)th stage scanning signal G(n+1). The pull-down maintaining circuit 406 is configured to maintain the current-stage scanning voltage level signal Q(n) at the low voltage level and the scanning signal G(n) at the low voltage level. The bootstrap capacitor Cb is configured to generate the current-stage scanning voltage level signal Q(n) at the high voltage level. The conducting control circuit 402 is configured to control the conducted time when the pull-down maintaining circuit 406 receives a square-wave signal of the TFT (such as the first square-wave signal LC1 or the second square-wave signal LC2). The output terminal of the pull-up control circuit 401 is electrically connected to the pull-up circuit 403, the downlink circuit 404, the pull-down circuit 405, the pull-down maintaining circuit 406, and the bootstrap capacitor Cb. The constant voltage supply VSS is electrically connected to the pull-down maintaining circuit 406 and the pull-down circuit 405. The clock signal source CLK is electrically connected to the pull-up circuit 403, the downlink circuit 404, and the conducting control circuit 402, respectively. The conducting control circuit 402 is electrically connected to the pull-down maintaining circuit 406.

In the first embodiment, the conducting control circuit 402 includes a first TFT T55 and a second TFT T65. A gate of the first TFT T55 receives a current-stage clock signal CLK1/2. A source of the first TFT T55 receives the first square-wave signal LC1. A drain of the first TFT T55 as a first output terminal of the conducting control circuit 402 is electrically connected to the pull-down maintaining circuit 406. A gate of the second TFT T65 receives the current-stage clock signal CLK1/2. A source of the second TFT T65 receives the second square-wave signal LC2. A drain of the second TFT T65 as a second output terminal of the conducting control circuit 402 is electrically connected to the pull-down maintaining circuit 406.

The pull-up circuit 403 includes a fourth TFT T21. A gate of the fourth TFT T21 is electrically connected to the output terminal of the pull-up control circuit 401. A drain of the fourth TFT T21 receives a clock signal CLK. A source of the fourth TFT T21 is electrically connected to the current-stage scanning signal G(n).

The pull-down circuit 405 includes a sixth TFT T31 and a ninth TFT T41. A gate of the sixth TFT T31 is electrically connected to an (n+1)th stage scanning signal G(n+1). A source of the sixth TFT T31 is electrically connected to the constant voltage supply VSS. A drain of the sixth TFT T31 is electrically connected to the current-stage scanning signal. A gate of the ninth TFT T41 is electrically connected to the (n+1)th stage scanning signal G(n+1). A source of the ninth TFT T41 is electrically connected to the constant voltage supply VSS. A drain of the ninth TFT T41 is electrically connected to the output terminal of the pull-up control circuit 401.

The pull-up control circuit 401 includes an twentieth TFT T11. A gate of the twentieth TFT T11 receives the (n−1)th stage cascade signal ST(n−1). A source of the twentieth TFT T11 is electrically connected to the output terminal of the pull-up control circuit 401. A drain of the twentieth TFT T11 receives the (n−1)th stage scanning signal ST(n−1).

The downlink circuit 404 includes a fifth TFT T22. A gate of the TFT T22 is electrically connected to the output terminal of the pull-up control circuit 401. A source of the fifth TFT T22 receives an nth stage cascade signal ST(n).

The pull-down maintaining circuit 406 includes a first pull-down maintaining circuit 4061 circuit and a second pull-down maintaining circuit 4062.

The first pull-down maintaining circuit 4061 includes a twelfth TFT T51, a thirteenth TFT T52, a fourteenth TFT T53, a fifteenth TFT T54, a tenth TFT T42, and a seventh TFT T32. A gate and a drain of the twelfth TFT T51 are electrically connected to the first output terminal of the conducting control circuit 402. A source of the twelfth TFT T51 is electrically connected to a drain of the thirteenth TFT T52 and a gate of the fourteenth TFT T53. A gate of the thirteenth TFT T52 receives the current-stage scanning voltage level signal. A source of the thirteenth TFT T52 is electrically connected to the constant voltage supply VSS. A drain of the fourteenth TFT T53 is electrically connected to the first output terminal of the conducting control circuit 402. A source of the fourteenth TFT T53 is electrically connected to a drain of the fifteenth TFT T54, a gate of the tenth TFT T42, and a gate of the seventh TFT T32. A gate of the fifteenth TFT T54 receives the current-stage scanning voltage level signal. A source of the fifteenth TFT T54 is electrically connected to the constant voltage supply VSS. A source of the tenth TFT T42 is electrically connected to the constant voltage supply VSS. A drain of the tenth TFT T42 is electrically connected to the output terminal of the pull-up control circuit 401. A source of the seventh TFT T32 is electrically connected to the constant voltage supply VSS. A drain of the seventh TFT T32 receives the current-stage scanning signal G(n).

The second pull-down maintaining circuit 4062 includes a sixteenth TFT T61, a seventeenth TFT T62, an eighteenth TFT T63, a nineteenth TFT T64, a eleventh TFT T43, and an eighth TFT T33. A gate and a drain of the sixteenth TFT T61 are electrically connected to the second output terminal of the conducting control circuit 402. A source of the sixteenth TFT T61 is electrically connected to a drain of the seventeenth TFT T62 and a gate of the eighteenth TFT T63. A gate of the seventeenth TFT T62 receives the current-stage scanning voltage level signal. A source of the seventeenth TFT T62 is electrically connected to the constant voltage supply VSS. A drain of the eighteenth TFT T63 is electrically connected to the second output terminal of the conducting control circuit 402. A source of the eighteenth TFT T63 is electrically connected to a drain of the nineteenth TFT T64, a gate of the eleventh TFT T43, and a gate of the eighth TFT T33. A gate of the nineteenth TFT T64 receives the current-stage scanning voltage level signal. A source of the nineteenth TFT T64 is electrically connected to the constant voltage supply VSS. A source of the eleventh TFT T43 is electrically connected to the constant voltage supply VSS. A drain of the eleventh TFT T43 is electrically connected to the output terminal of the pull-up control circuit 401. A source of the eighth TFT T33 is electrically connected to the constant voltage supply VSS. A drain of the eighth TFT T33 receives the current-stage scanning signal G(n).

The bootstrap capacitor Cb is arranged between the output terminal of the pull-up control circuit 401 and the current-stage scanning signal G(n).

In addition, a first square-wave signal LC1 and a second square-wave signal LC2 both are square waves of which a duty cycle is ½. The phase difference between the first square-wave signal LC1 and the second square-wave signal LC2 is half the cycle. The first pull-down maintaining circuit 4061 and the second pull-down maintaining circuit 4062 work alternatively to stabilize the whole circuit.

The working principle of the GOA circuit proposed by the first embodiment of the present disclosure is detailed as follows.

Please continue referring to FIG. 4 and FIG. 6. When starting to work, the GOA circuit is scanned through an enabling signal STV. When the (n−1)th stage cascade signal ST(n−1) is at the high voltage level, the twentieth TFT T11 is turned on. A (n−1)th stage scanning signal G(n−1) at the high voltage level charges the bootstrap capacitor Cb through the twentieth TFT T11 to make the reference node Q(n) rise to a higher voltage level. Afterwards, the (n−1)th stage cascade signal ST(n−1) is turned into the low voltage level, the twentieth TFT T11 is turned off. The reference node Q(n) keeps at the higher voltage level through the bootstrap capacitor Cb. At this time, a fourth TFT T21 and the fifth TFT T22 are turned on.

When the current-stage clock signal is turned into the current-stage clock signal at the high voltage level, the bootstrap capacitor Cb keeps be charged through the fourth TFT T21 to force the reference node Q(n) to reach a higher voltage level. Meanwhile, the current-stage scanning signal G(n) and the nth stage cascade signal ST(n) are turned into the current-stage scanning signal G(n) at the first high voltage level VGH and the nth stage cascade signal ST(n) at the first high voltage level VGH as well.

Meanwhile, the current-stage clock signal CLK1/2 is at the high voltage level so the first TFT T55 is turned on (or the second TFT T65 is turned on), thereby making the twelfth TFT T51 and the thirteenth TFT T52 (or the sixteenth TFT T61 and the seventeenth TFT T62) be turned on. It shows that the first square-wave signal LC1 (or the second square-wave signal LC2) is conducted to the constant voltage supply VSS through the twelfth TFT T51 and the thirteenth TFT T52. The conducted time is t2. Besides, the voltage level of the reference node S is low voltage level, as illustrated in FIG. 6.

When the current-stage signal is turned into the first low voltage level, the first TFT T55 is turned off (or the second TFT T65 is turned off), thereby making the twelfth TFT T51 and the thirteenth TFT T52 (or the sixteenth TFT T61 and the seventeenth TFT T62) be turned off. At this time, the first square-wave signal LC1 (or the second square-wave signal LC2) is not conducted to the constant voltage supply VSS. The non-conducted time is t1. Besides, the voltage level of the reference node S is high voltage level, as illustrated in FIG. 6.

Therefore, compared with the GOA circuit of the related art, the first square-wave signal LC1 (or the second square-wave signal LC2) is conducted to the constant voltage supply VSS in the GOA circuit proposed by the first embodiment. The conducted time is reduced from t1+t2 to t2. In this way, the aging speed of the twelfth TFT T51 and the aging speed of the thirteenth TFT T52 (or the sixteenth TFT T61 and the seventeenth TFT T62) are inhibited, and meanwhile the power consumption of the GOA circuit is lowered.

In the meanwhile, the current-stage clock signal is turned into the first low voltage level so the third TFT T23 is turned off. Therefore, the voltage level of the current-stage scanning signal G(n) is set to be at the first low voltage level.

Subsequently, when the (n+1)th stage scanning signal G(n+1) is at the high voltage level, the sixth TFT T31 and the ninth TFT T41 are turned on. The current-stage scanning signal G(n) at the voltage level is turned into the second low voltage level through the constant voltage supply VSS. The first low voltage level is less than the second low voltage level so the feed-through voltage generated by a parasitic capacitor is compensated.

Finally, the first pull-down maintaining circuit 4061 and the second pull-down maintaining circuit 4062 work alternatively to stabilize the whole circuit to assure the reference node Q(n) at the low voltage level, thereby making the current-stage scanning signal G(n) keep at the second low voltage level.

Figure 5:
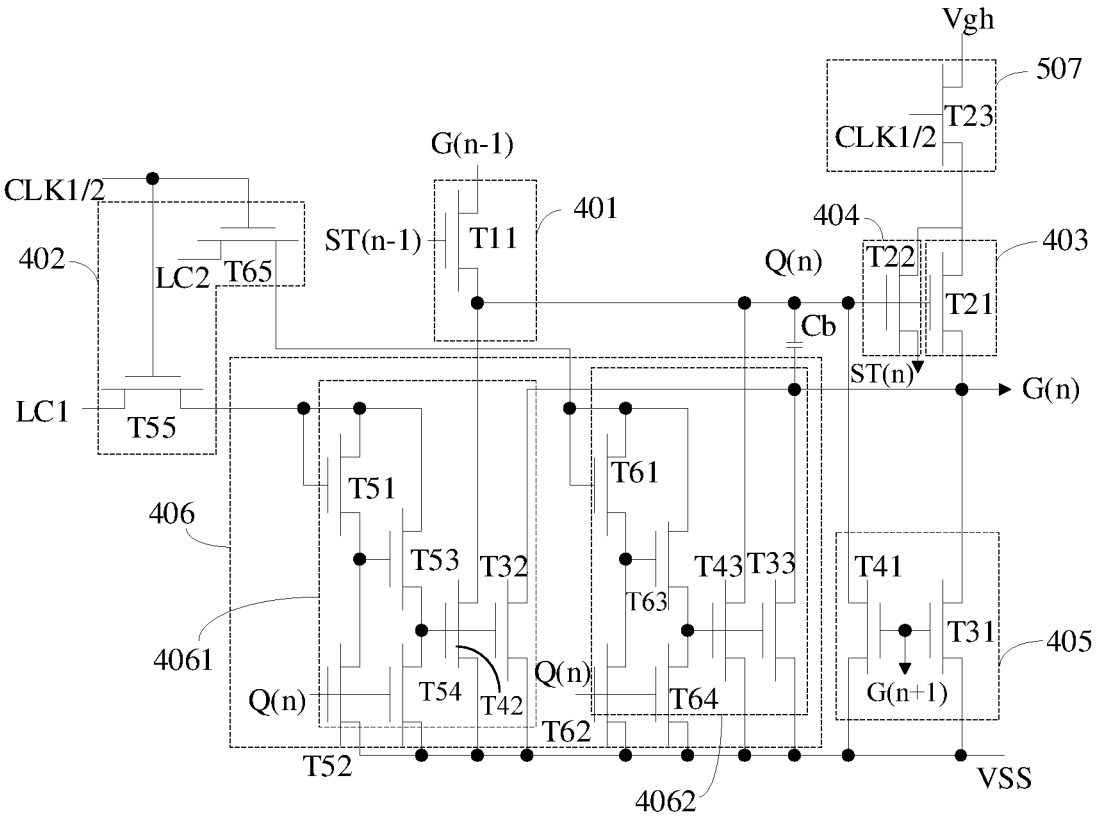
FIG. 5 is a circuit diagram of a GOA circuit according to another embodiment of the present disclosure.

Please refer to FIG. 5. The structure of the GOA circuit proposed by a second embodiment is basically the same as the structure of the GOA circuit proposed by the first embodiment. In the second embodiment, the GOA circuit further includes a beveled control signal circuit 507. The beveled control signal circuit 507 is configured to output a beveled control signal after receiving a high voltage level signal under the control of the current-stage clock signal CLK1/2. Meanwhile, the pull-up circuit 403 is configured to output the beveled control signal to the output terminal G(n) of the current-stage scanning signal under the control of the current-stage scanning voltage level signal Q(n). The downlink circuit 404 is configured to receive the beveled control signal and generate the nth stage cascade signal under the control of the current-stage scanning voltage level signal Q(n). The clock signal source CLK is electrically connected to the beveled control signal circuit 507. The beveled control signal circuit 507 is electrically connected to the pull-up circuit 403 and the downlink circuit 404.

Further, a beveled control signal circuit 507 includes a third TFT T23. A gate of the third TFT T23 receives the current-stage clock signal CLK1/2. A drain of the third TFT T23 receives the beveled control signal. A source of the third TFT T23 is electrically connected to the pull-up circuit 403 and the downlink circuit 404. The feed-through effect exists in the GOA circuit of the related art so it is necessary to bevel the gate scanning signal. A periodic beveled control signal is input to improve the gate scanning signal, thereby improving the display effect and use reliability of the liquid crystal display.

The working principle of the GOA circuit proposed by the second embodiment of the present disclosure is the same as the working principle of the GOA circuit proposed by the first embodiment. However, when the current-stage clock signal is turned into the current-stage clock signal at the high voltage level, the third TFT is controlled to be turned on. Therefore, the beveled control signal circuit 507 outputs a beveled control signal, and the beveled control signal is transmitted to the current-stage scanning signal G(n) through the pull-up circuit 403.

Figure 7:
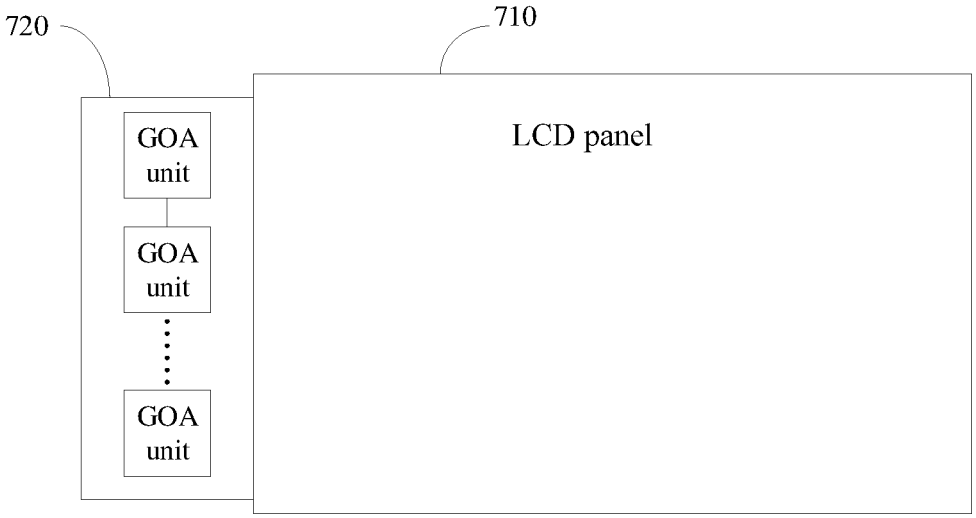
FIG. 7 is a schematic diagram of a liquid crystal display according to an embodiment of the present disclosure.

FIG. 7 is a schematic diagram of a liquid crystal panel according to another embodiment of the present disclosure. The present disclosure proposes a liquid crystal display (LCD), and the LCD includes a gate driver on array (GOA) circuit 720 as introduced above.

The LCD includes a liquid crystal panel 710 and the GOA circuit 720 arranged on one side of the liquid crystal panel 710. The structure of the GOA circuit 720 and the working principle of the GOA circuit 720 may be referred to the above-mentioned embodiment, which will not be detailed.

New TFTs, such as the first TFT T55 and the second TFT T65 as illustrated in FIG. 4, are added to an input terminal of a twelfth TFT T51 and an input terminal of a sixteenth TFT T61 in the GOA circuit, respectively. The gates of the new added TFTs both are connected to an input terminal of a clock signal CLK1/2; that is, the TFTs are controlled by the same clock signal. The sources of the new added TFTs are connected to the first square-wave signal LC1 and the second square-wave signal LC2, respectively. Therefore, when the current-stage clock signal is at the high voltage level, the twelfth TFT T51 and the thirteenth TFT T52 (or the sixteenth TFT T61 and the seventeenth TFT T62) are turned on. When the current-stage clock signal is at the low voltage level, the twelfth TFT T51 and the thirteenth TFT T52 (or the sixteenth TFT T61 and the seventeenth TFT T62) are turned off. So the first square-wave signal LC1 (or the second square-wave signal LC2) is conducted to the constant voltage supply VSS. The conducted time is reduced from t1+t2 to t2. Therefore, not only the lifespan of the GOA circuit prolongs but also power consumption of the liquid crystal panel reduces.

In addition, a TFT T23 is added to an input terminal of the pull-up circuit 403 in the GOA circuit. A gate of the third TFT T23 is electrically connected to the clock signal. An input terminal of the third TFT T23 receives the periodic beveled control signal. Therefore, the feed-through effect on the driven liquid crystal panel decreases while the display effect and use reliability of the liquid crystal panel increases.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A gate driver on array (GOA) circuit applied to a liquid crystal panel, the GOA circuit comprising a plurality of cascaded GOA unit circuits, wherein an nth stage GOA unit circuit comprising:

a clock signal source, configured to supply a current-stage clock signal, the current-stage clock signal comprising a first high voltage level and a first low voltage level;

a constant voltage supply, configured to supply a second low voltage level;

a pull-up control circuit, configured to receive an (n−1)th stage scanning signal and generate a current-stage scanning voltage level signal under a control of an (n−1)th stage cascade signal;

a pull-up circuit, configured to output the current-stage clock signal to an output terminal of the nth stage GOA unit circuit under a control of the current-stage scanning voltage level signal;

a downlink circuit, configured to receive the current-stage clock signal and generate an nth stage cascade signal under a control of the current-stage scanning voltage level signal;

a pull-down circuit, configured to output the second low voltage level supplied by the constant voltage supply to the output terminal of the nth stage GOA unit circuit according to an (n+1)th stage scanning signal;

a pull-down maintaining circuit, configured to maintain the current-stage scanning voltage level signal at a low voltage level;

a bootstrap capacitor, configured to generate the current-stage scanning voltage level signal at a high voltage level; and a conducting control circuit comprising a first thin film transistor (TFT) and a second TFT, configured to control a conducted time of the pull-down maintaining circuit when the pull-down maintaining circuit receives a square-wave signal from the first TFT or the second TFT of the conducting control circuit, wherein a gate of the first TFT receives the current-stage clock signal; a source of the first TFT receives a first square-wave signal; a drain of the first TFT is electrically connected to the pull-down maintaining circuit; a gate of the second TFT receives the current-stage clock signal; a source of the second TFT receives a second square-wave signal; a drain of the second TFT is electrically connected to the pull-down maintaining circuit; and a beveled control signal circuit, configured to output a beveled control signal under the control of the current-stage clock signal; the pull-up circuit configured to output the beveled control signal to the output terminal of the nth stage GOA unit circuit under the control of the current-stage scanning voltage level signal; the downlink circuit configured to receive the beveled control signal and generate a second stage cascade signal under the control of the current-stage scanning voltage level signal; the clock signal source is electrically connected to the beveled control signal circuit; the beveled control signal circuit is electrically connected to the pull-up circuit and the downlink circuit;

wherein an output terminal of the pull-up control circuit is electrically connected to the pull-up circuit, the downlink circuit, the pull-down circuit, the pull-down maintaining circuit, and the bootstrap capacitor; the constant voltage supply is electrically connected to the pull-down maintaining circuit and the pull-down circuit; the clock signal source is electrically connected to the pull-up circuit, the downlink circuit, and the conducting control circuit; the conducting control circuit is electrically connected to the pull-down maintaining circuit.

2. The GOA circuit of claim 1, wherein the pull-up circuit comprises a fourth TFT; a gate of the fourth TFT is electrically connected to the output terminal of the pull-up control circuit; a drain of the fourth TFT is electrically connected to the beveled control signal circuit; a source of the fourth TFT is electrically connected to the output terminal of the nth stage GOA unit circuit.

3. The GOA circuit of claim 1, wherein the pull-down circuit comprises a sixth TFT and a ninth TFT; a gate of the sixth TFT is electrically connected to the (n+1)th stage scanning signal; a source of the sixth TFT is electrically connected to the constant voltage supply; a drain of the sixth TFT is electrically connected to the output terminal of the nth stage GOA unit circuit; a gate of the ninth TFT is electrically connected to the (n+1)th stage scanning signal; a source of the ninth TFT is electrically connected to the constant voltage supply; a drain of the ninth TFT is electrically connected to the output terminal of the pull-up control circuit.

4. The GOA circuit of claim 1, wherein the pull-up control circuit comprises an twentieth TFT; a gate of the twentieth TFT receives the (n−1)th stage cascade signal; a source of the twentieth TFT is electrically connected to the output terminal of the pull-up control circuit; a drain of the twentieth TFT receives the (n−1)th stage scanning signal.

5. The GOA circuit of claim 1, wherein the downlink circuit comprises a fifth TFT; a gate of the fifth TFT is electrically connected to the output terminal of the pull-up control circuit; a source of the fifth TFT receives the nth stage cascade signal.

6. The GOA circuit of claim 1, wherein the pull-down maintaining circuit comprises a first pull-down maintaining circuit and a second pull-down maintaining circuit; the first pull-down maintaining circuit comprises a twelfth TFT, a thirteenth TFT, a fourteenth TFT, a fifteenth TFT, a tenth TFT, and a seventh TFT; a gate and a drain of the twelfth TFT are electrically connected to a first output terminal of the conducting control circuit; a source of the twelfth TFT is electrically connected to a drain of the thirteenth TFT and a gate of the fourteenth TFT; a gate of the thirteenth TFT receives the current-stage scanning voltage level signal; a source of the thirteenth TFT is electrically connected to the constant voltage supply; a drain of the fourteenth TFT is electrically connected to the first output terminal of the conducting control circuit; a source of the fourteenth TFT is electrically connected to a drain of the fifteenth TFT, a gate of the tenth TFT, and a gate of the seventh TFT; a gate of the fifteenth TFT receives the current-stage scanning voltage level signal; a source of the fifteenth TFT is electrically connected to the constant voltage supply; a source of the tenth TFT is electrically connected to the constant voltage supply; a drain of the tenth TFT is electrically connected to the output terminal of the pull-up control circuit; a source of the seventh TFT is electrically connected to the constant voltage supply; a drain of the seventh TFT receives the current-stage scanning signal; the second pull-down maintaining circuit comprises a sixteenth TFT, a seventeenth TFT, an eighteenth TFT, a nineteenth TFT, a eleventh TFT, and an eighth TFT; a gate and a drain of the sixteenth TFT are electrically connected to a second output terminal of the conducting control circuit; a source of the sixteenth TFT is electrically connected to a drain of the seventeenth TFT and a gate of the eighteenth TFT; a gate of the seventeenth TFT receives the current-stage scanning voltage level signal; a source of the seventeenth TFT is electrically connected to the constant voltage supply; a drain of the eighteenth TFT is electrically connected to the second output terminal of the conducting control circuit; a source of the eighteenth TFT is electrically connected to a drain of the nineteenth TFT, a gate of the eleventh TFT, and a gate of the eighth TFT; a gate of the nineteenth TFT receives the current-stage scanning voltage level signal; a source of the nineteenth TFT is electrically connected to the constant voltage supply; a source of the eleventh TFT is electrically connected to the constant voltage supply; a drain of the eleventh TFT is electrically connected to the output terminal of the pull-up control circuit; a source of the eighth TFT is electrically connected to the constant voltage supply; a drain of the eighth TFT receives the current-stage scanning signal.

7. A gate driver on array (GOA) circuit applied to a liquid crystal panel, the GOA circuit comprising a plurality of cascaded GOA unit circuits, wherein an nth stage GOA unit circuit comprising:

a clock signal source, configured to supply a current-stage clock signal, the current-stage clock signal comprising a first high voltage level and a first low voltage level;

a constant voltage supply, configured to supply a second low voltage level;

a pull-up control circuit, configured to receive an (n−1)th stage scanning signal and generate a current-stage scanning voltage level signal under a control of an (n−1)th stage cascade signal;

a pull-up circuit, configured to output the current-stage clock signal to an output terminal of the nth stage GOA unit circuit under a control of the current-stage scanning voltage level signal;

a downlink circuit, configured to receive the current-stage clock signal and generate an nth stage cascade signal under a control of the current-stage scanning voltage level signal;

a pull-down circuit, configured to output the second low voltage level supplied by the constant voltage supply to the output terminal of the nth stage GOA unit circuit according to an (n+1)th stage scanning signal;

a pull-down maintaining circuit, configured to maintain the current-stage scanning voltage level signal at a low voltage level;

a bootstrap capacitor, configured to generate the current-stage scanning voltage level signal at a high voltage level; and a conducting control circuit comprising a first thin film transistor (TFT) and a second TFT, configured to control a conducted time of the pull-down maintaining circuit when the pull-down maintaining circuit receives a square-wave signal from the first TFT or the second TFT of the conducting control circuit, wherein a gate of the first TFT receives the current-stage clock signal; a source of the first TFT receives a first square-wave signal; a drain of the first TFT is electrically connected to the pull-down maintaining circuit; a gate of the second TFT receives the current-stage clock signal; a source of the second TFT receives a second square-wave signal; a drain of the second TFT is electrically connected to the pull-down maintaining circuit.

8. The GOA circuit of claim 7, wherein the GOA circuit further comprises a beveled control signal circuit, configured to output a beveled control signal under the control of the current-stage clock signal; the pull-up circuit configured to output the beveled control signal to the output terminal of the nth stage GOA unit circuit under the control of the current-stage scanning voltage level signal; the downlink circuit configured to receive the beveled control signal and generate a second stage cascade signal under the control of the current-stage scanning voltage level signal; the clock signal source electrically connected to the beveled control signal circuit; the beveled control signal circuit electrically connected to the pull-up circuit and the downlink circuit.

9. The GOA circuit of claim 8, wherein the beveled control signal circuit comprises a third TFT, the third TFT comprises a gate coupled to the current-stage clock signal, a drain coupled to the beveled control signal, and a source coupled the pull-up circuit and the downlink circuit.

10. The GOA circuit of claim 8, wherein the pull-up circuit comprises a fourth TFT; a gate of the fourth TFT is electrically connected to the output terminal of the pull-up control circuit; a drain of the fourth TFT is electrically connected to the beveled control signal circuit; a source of the fourth TFT is electrically connected to the output terminal of the nth stage GOA unit circuit.

11. The GOA circuit of claim 7, wherein the pull-down circuit comprises a sixth TFT and a ninth TFT; a gate of the sixth TFT is electrically connected to the (n+1)th stage scanning signal; a source of the sixth TFT is electrically connected to the constant voltage supply; a drain of the sixth TFT is electrically connected to the output terminal of the nth stage GOA unit circuit; a gate of the ninth TFT is electrically connected to the (n+1)th stage scanning signal; a source of the ninth TFT is electrically connected to the constant voltage supply; a drain of the ninth TFT is electrically connected to the output terminal of the pull-up control circuit.

12. The GOA circuit of claim 7, wherein the pull-up control circuit comprises an twentieth TFT; a gate of the twentieth TFT receives the (n−1)th stage cascade signal; a source of the twentieth TFT is electrically connected to the output terminal of the pull-up control circuit; a drain of the twentieth TFT receives the (n−1)th stage scanning signal.

13. The GOA circuit of claim 7, wherein the downlink circuit comprises a fifth TFT; a gate of the fifth TFT is electrically connected to the output terminal of the pull-up control circuit; a source of the fifth TFT receives the nth stage cascade signal.

14. The GOA circuit of claim 7, wherein the pull-down maintaining circuit comprises a first pull-down maintaining circuit and a second pull-down maintaining circuit; the first pull-down maintaining circuit comprises a twelfth TFT, a thirteenth TFT, a fourteenth TFT, a fifteenth TFT, a tenth TFT, and a seventh TFT; a gate and a drain of the twelfth TFT are electrically connected to a first output terminal of the conducting control circuit; a source of the twelfth TFT is electrically connected to a drain of the thirteenth TFT and a gate of the fourteenth TFT; a gate of the thirteenth TFT receives the current-stage scanning voltage level signal; a source of the thirteenth TFT is electrically connected to the constant voltage supply; a drain of the fourteenth TFT is electrically connected to the first output terminal of the conducting control circuit; a source of the fourteenth TFT is electrically connected to a drain of the fifteenth TFT, a gate of the tenth TFT, and a gate of the seventh TFT; a gate of the fifteenth TFT receives the current-stage scanning voltage level signal; a source of the fifteenth TFT is electrically connected to the constant voltage supply; a source of the tenth TFT is electrically connected to the constant voltage supply; a drain of the tenth TFT is electrically connected to the output terminal of the pull-up control circuit; a source of the seventh TFT is electrically connected to the constant voltage supply; a drain of the seventh TFT receives the current-stage scanning signal; the second pull-down maintaining circuit comprises a sixteenth TFT, a seventeenth TFT, an eighteenth TFT, a nineteenth TFT, a eleventh TFT, and an eighth TFT; a gate and a drain of the sixteenth TFT are electrically connected to a second output terminal of the conducting control circuit; a source of the sixteenth TFT is electrically connected to a drain of the seventeenth TFT and a gate of the eighteenth TFT; a gate of the seventeenth TFT receives the current-stage scanning voltage level signal; a source of the seventeenth TFT is electrically connected to the constant voltage supply; a drain of the eighteenth TFT is electrically connected to the second output terminal of the conducting control circuit; a source of the eighteenth TFT is electrically connected to a drain of the nineteenth TFT, a gate of the eleventh TFT, and a gate of the eighth TFT; a gate of the nineteenth TFT receives the current-stage scanning voltage level signal; a source of the nineteenth TFT is electrically connected to the constant voltage supply; a source of the eleventh TFT is electrically connected to the constant voltage supply; a drain of the eleventh TFT is electrically connected to the output terminal of the pull-up control circuit; a source of the eighth TFT is electrically connected to the constant voltage supply; a drain of the eighth TFT receives the current-stage scanning signal.

15. A liquid crystal display comprising the GOA circuit as claimed in claim 7.

* * * * *